US007604490B2

(12) United States Patent
Chen et al.

(10) Patent No.: US 7,604,490 B2
(45) Date of Patent: Oct. 20, 2009

(54) ELECTRICAL CONNECTOR WITH IMPROVED GROUND PIECE

(75) Inventors: Kuan-Yu Chen, Harrisburg, PA (US); Chong Yi, Mechanicsburg, PA (US); Jia-Yong He, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/999,434

(22) Filed: Dec. 5, 2007

(65) Prior Publication Data

US 2009/0149045 A1 Jun. 11, 2009

(51) Int. Cl.
*H01R 12/00* (2006.01)

(52) U.S. Cl. ..... 439/79; 439/92; 439/541.5

(58) Field of Classification Search ..... 439/79, 439/92, 108, 607, 541.5
See application file for complete search history.

(56) References Cited

U.S. PATENT DOCUMENTS 6,835,092 B2 12/2004 Wan et al.
6,893,272 B2 5/2005 Yu
6,899,566 B2 5/2005 Kline et al.
7,044,779 B1 * 5/2006 Liu ..... 439/541.5
7,165,994 B2 1/2007 Ferry et al.

* cited by examiner

*Primary Examiner*—Khiem Nguyen
(74) *Attorney, Agent, or Firm*—Wei Te Chung; Andrew C. Cheng; Ming Chieh Chang

(57) ABSTRACT

An electrical connector includes an insulative housing, a plurality of first and second contacts retained in the insulative housing and a metallic ground. Each first contact comprises a first contact portion and a first mounting portion. Each second contact comprises a second contact portion and a second mounting portion. The first and second mounting portions are respectively arranged in first and second rows. The second contacts comprise a grounding contact. The ground piece comprises an elastic contact beam for abutting against the grounding contact so that the surface of the grounding contact is expanded. As a result, cross-talk occurred between the contacts can be decreased.

20 Claims, 8 Drawing Sheets

ELECTRICAL CONNECTOR WITH IMPROVED GROUND PIECE

BACKGROUND OF THE INVENTION

1. Field of the Invention

The present invention relates to an electrical connector, more particularly to an electrical connector having improved ground piece for cross-talk protection.

2. Description of related Art

With rapid development of electronic devices, there is a trend that the electronic devices have higher and higher data speed transmission. In order to meet such trend, electrical connectors mounted on PCB (Printed Circuit Board) of the electronic devices must add additional contacts to enhance data transmission. When a plurality of contacts work simultaneously, the contacts might occur cross-talk between each other. As a result, the quality and speed of data transmission are decreased.

Hence, it is desired to provide an electrical connector to overcome the problems mentioned above.

BRIEF SUMMARY OF THE INVENTION

Accordingly, an object of the present invention is to provide an electrical connector having an improved ground piece located between contacts for cross-talk protection.

The present invention is directed to an electrical connector includes an insulative housing, a plurality of first and second contacts retained in the insulative housing, a spacer fixed to the insulative housing and a metallic ground piece pressed into the spacer. Each first contact comprises a first contact portion and a first mounting portion. Each second contact comprises a second contact portion and a second mounting portion. The first and second mounting portions are respectively arranged in first and second rows. The second contacts comprise a grounding contact. The spacer defines a slot between the first row and the second row to receive the metallic ground piece. The ground piece comprises an elastic contact beam for abutting against the grounding contact so that the surface of the grounding contact is expanded. It is because that the ground piece is recognized as a part of the grounding contact under this condition. As a result, cross-talk occurred between the contacts can be decreased. Besides, addition of the ground piece also help lower the impedance between the first and second contacts. Further more, since the ground piece is received in the spacer, it does not affect the footprint of the electrical connector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
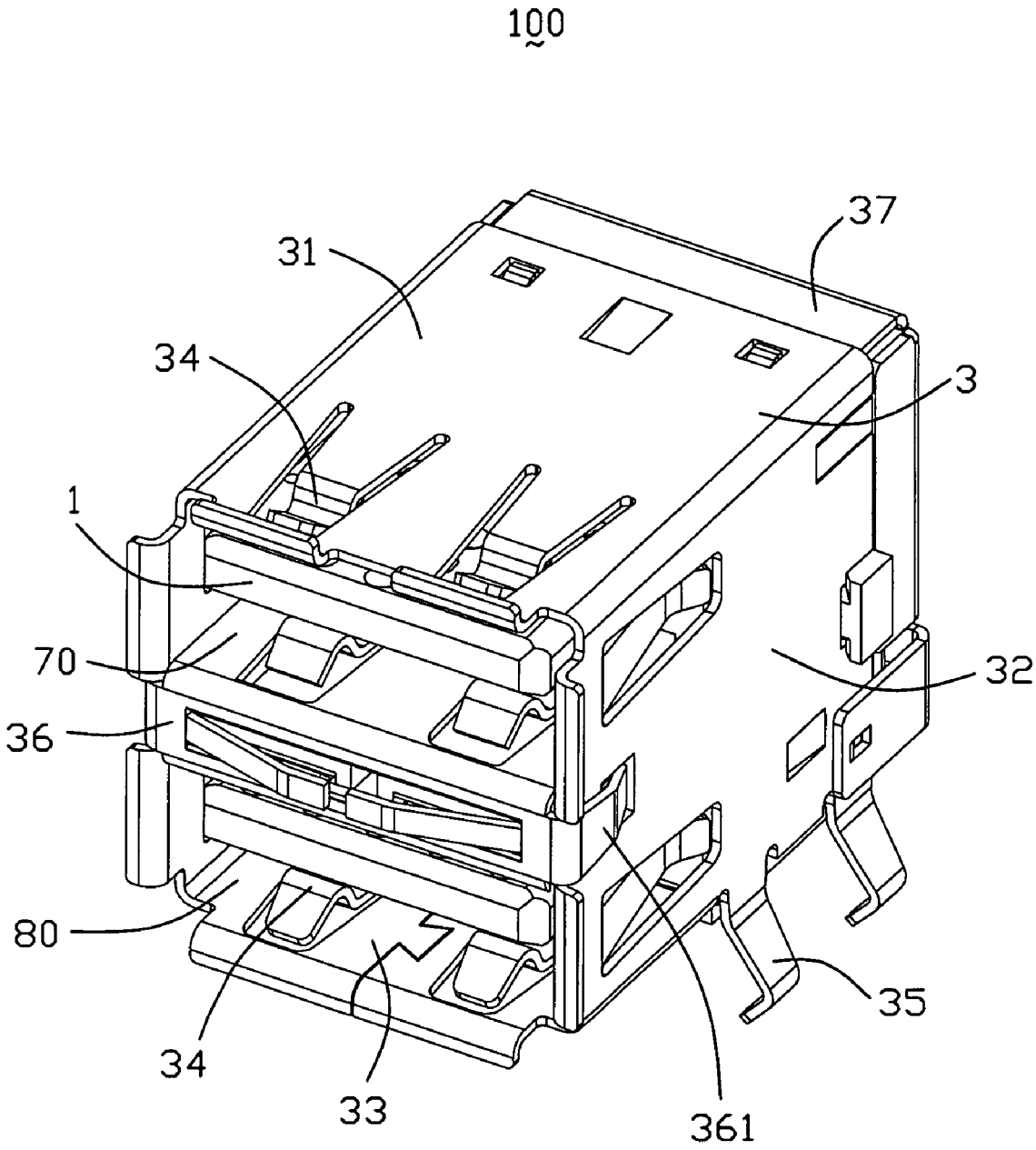
FIG. 1 is a perspective view of an electrical connector according to a preferred embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1 to 4, an electrical connector 100 to be mounted on a PCB (not shown) is disclosed. The electrical connector 100 mainly includes an insulative housing 1, a plurality of contacts 2 retained in the insulative housing 1 and a metal shield 3 enclosing the insulative housing 1. The insulative housing 1 shown in the preferred embodiment includes a separate insulator 10 and a pair of upper and lower tongue plate portions 50, 60 fixed to the insulator 10, which will be detailed hereinafter. The metal shield 3 encloses the upper and lower tongue plate portions 50, 60 to form a first and a second receiving opening 70, 80 therebetween.

The drawings of the preferred embodiment show a stacked electrical connector with two receptacles. However, it is easy to understand that the present invention could be used with any type of electrical connector. While each receptacle is shown with nine contacts 2 therein, the invention can be employed with any desired number of contacts 2. Similarly, the invention can be employed with a single receptacle or any desired number of stacked receptacles.

Figure 3:
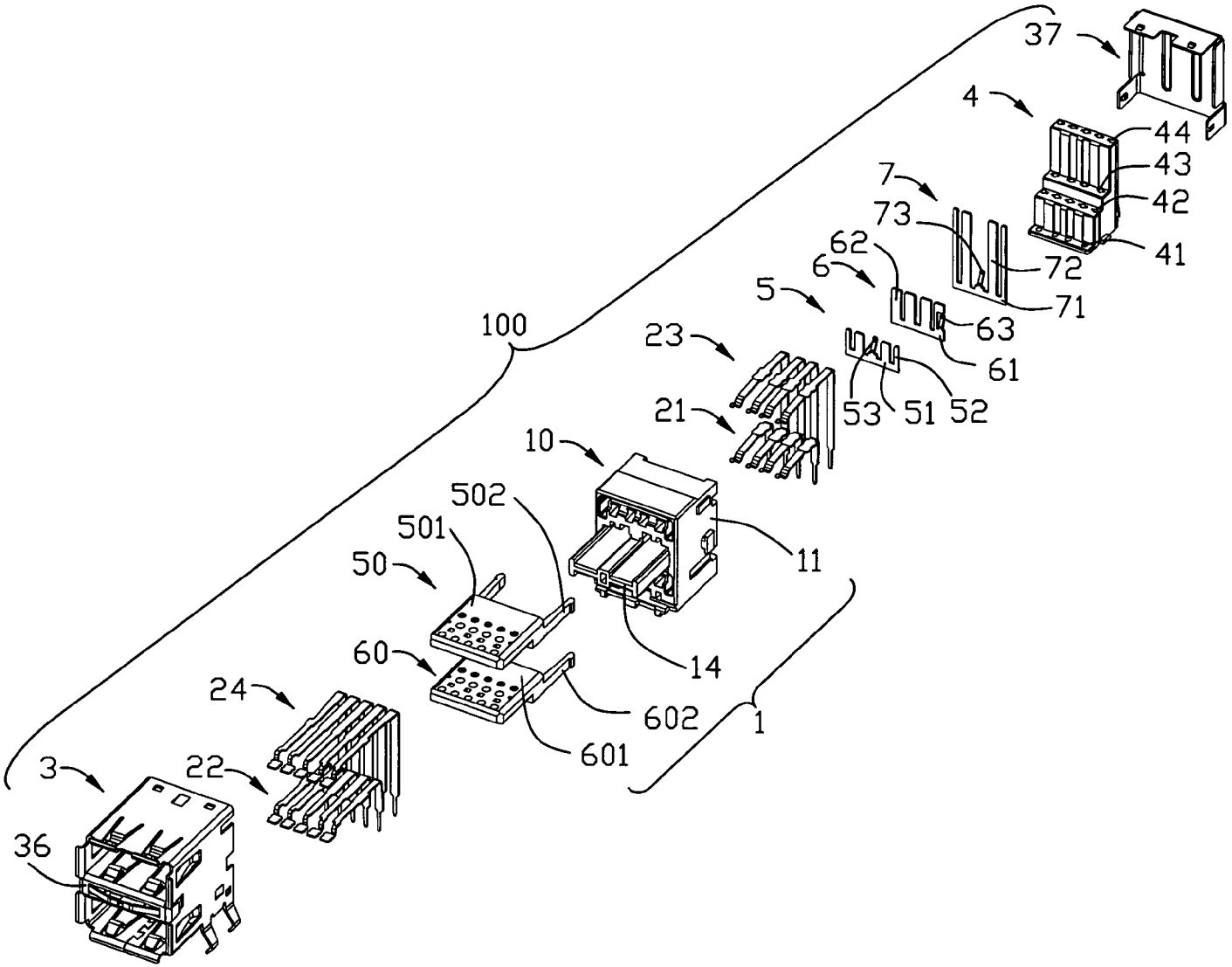
FIG. 3 is an exploded view of the electrical connector shown in FIG. 1.
Figure 4:
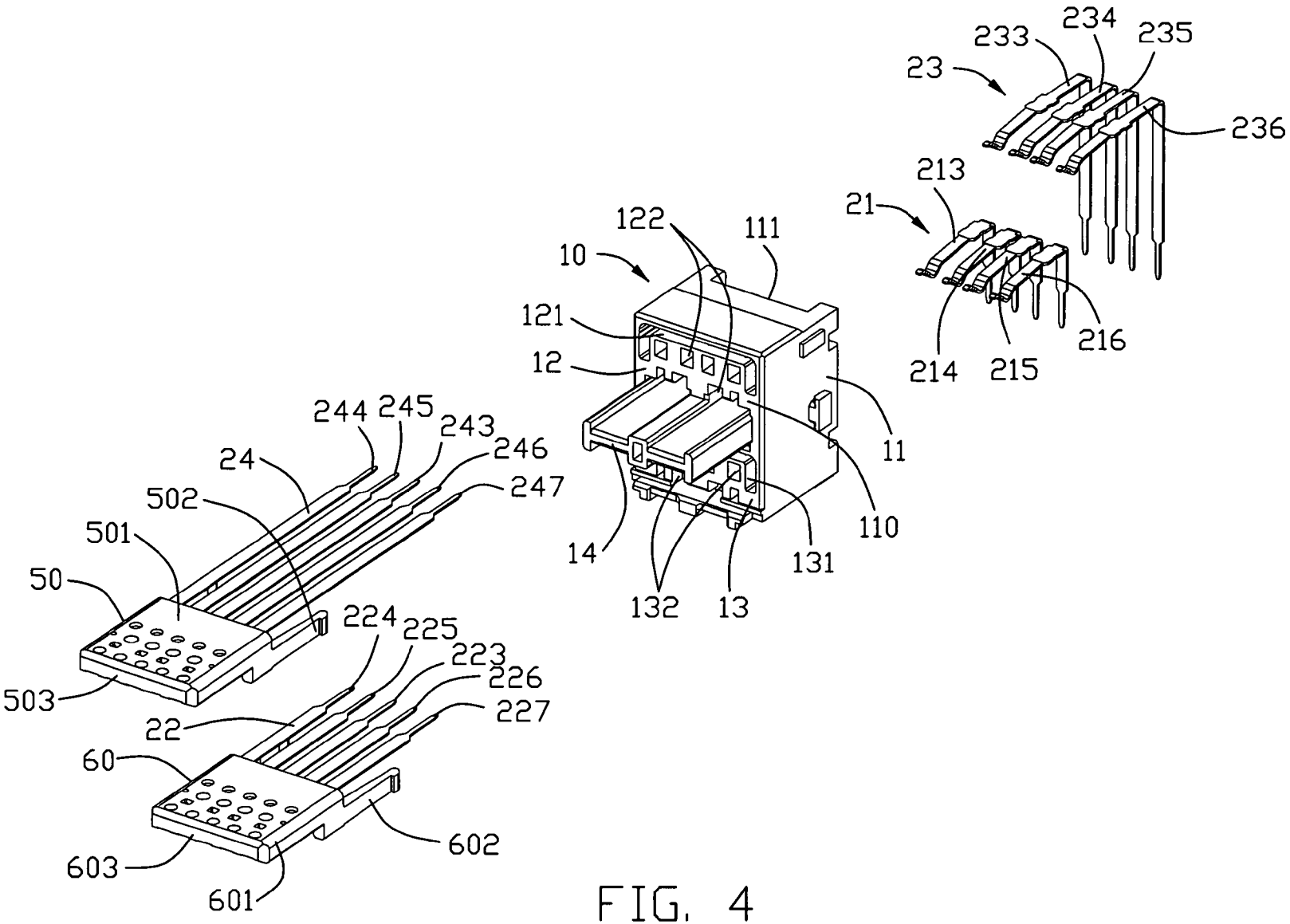
FIG. 4 is a part view of the electrical connector showing a plurality of contacts mounted on corresponding tongue plate portions and before tail portions of such contacts bended.

Referring to FIGS. 3 and 4, the insulator 10 includes a rectangular base 11, an upper area 12, a lower area 13 and a separated protrusion 14 extending forwardly from a front surface 110 of the base 11 to separate the upper and lower areas 12, 13. Each upper or lower area 12, 13 defines a U-shaped slot 121, 131 for receiving the tongue plate portions 50, 60 and a plurality of passageways 122, 132 for receiving the contacts 2. The base 11 further includes a rear surface 111 with the passageways 122, 132 extending through the front and rear surfaces 110, 111.

Figure 2:
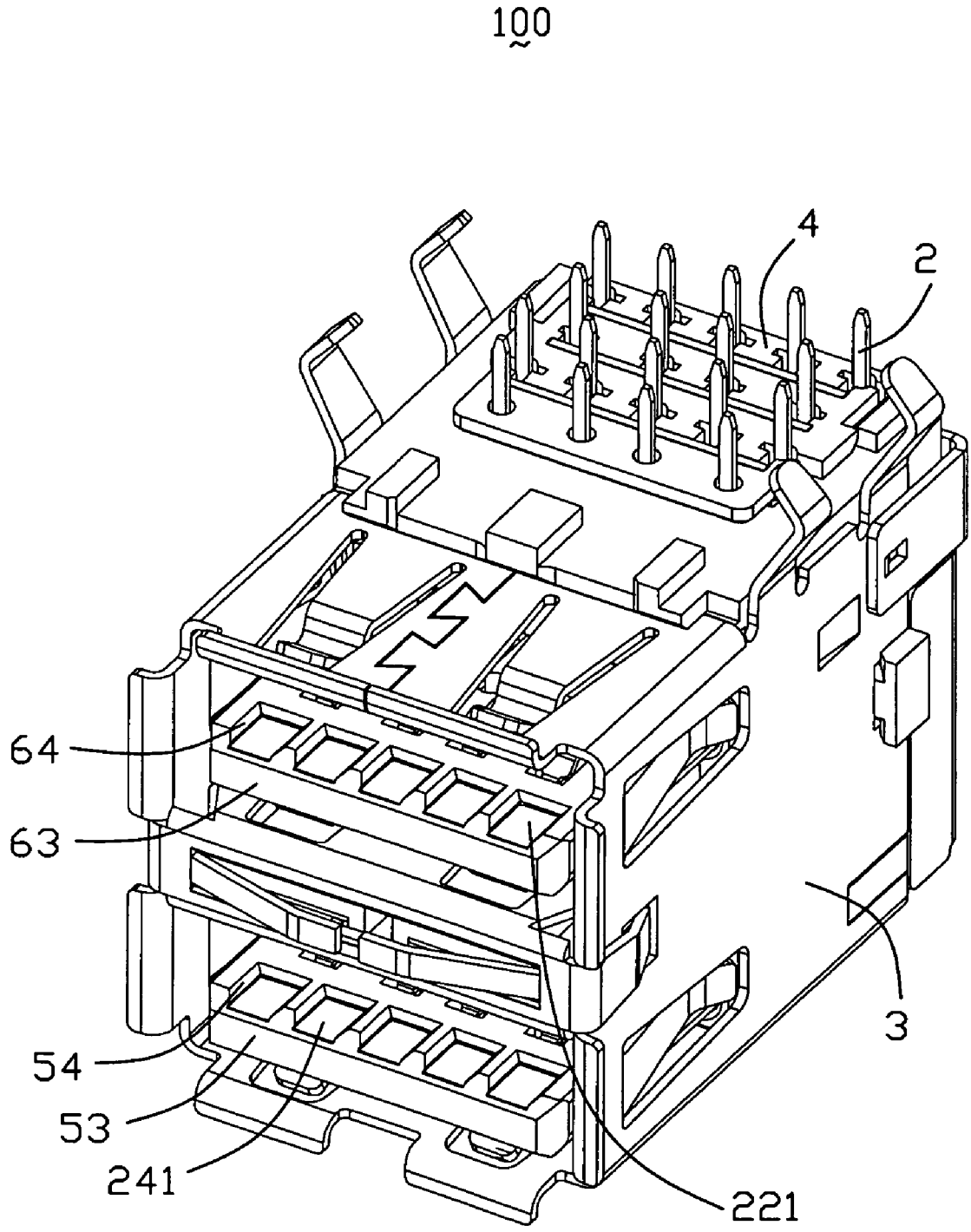
FIG. 2 is another perspective view of FIG. 1, but taken from another aspect.

Each tongue plate portion 50, 60 comprises a rectangular main body 501, 601 and a pair of latches 502, 602 extending backwardly from lateral sides of the main body 501, 601. Each main body 501, 601 defines a free end 503, 603 and a plurality of depressions 504, 604 adjacent to the corresponding free ends 503, 603 as shown in FIG. 2.

Figure 5:
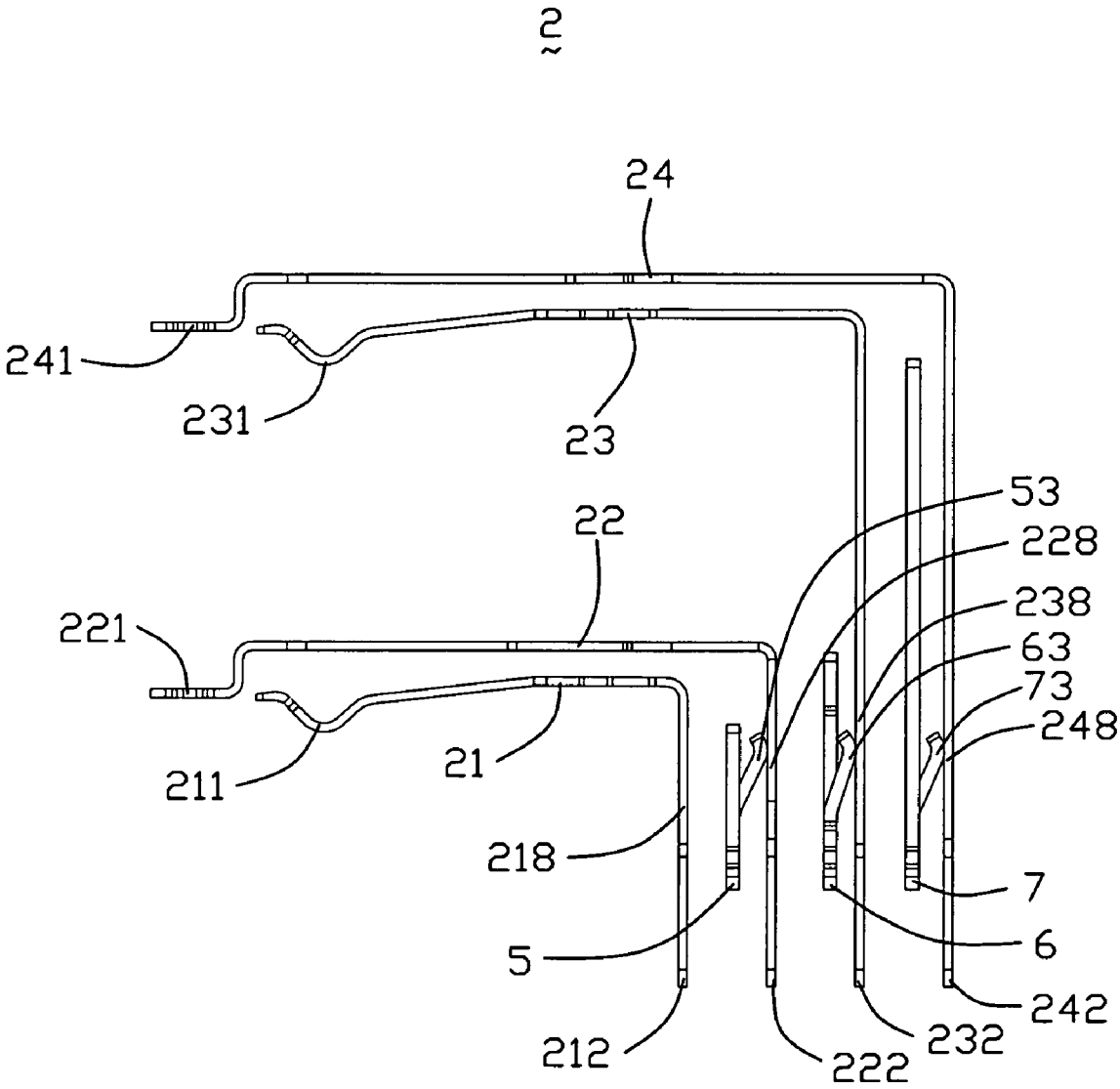
FIG. 5 is a perspective side view of the contacts and a plurality of ground pieces located between the contacts and abutting against corresponding contacts.
Figure 6:
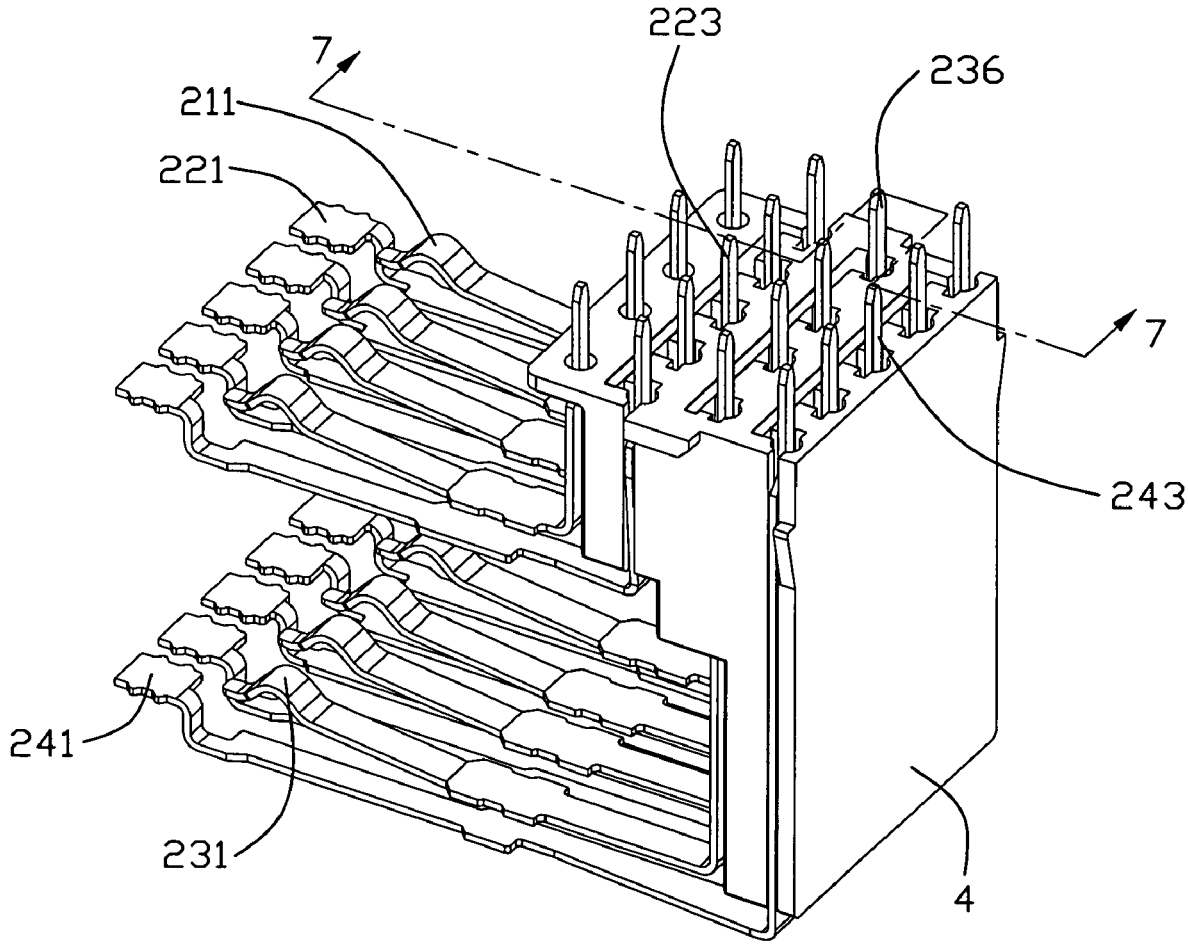
FIG. 6 is a perspective view of the contacts with the tail portions received in a spacer and the ground pieces pressed in the spacer.
Figure 7:
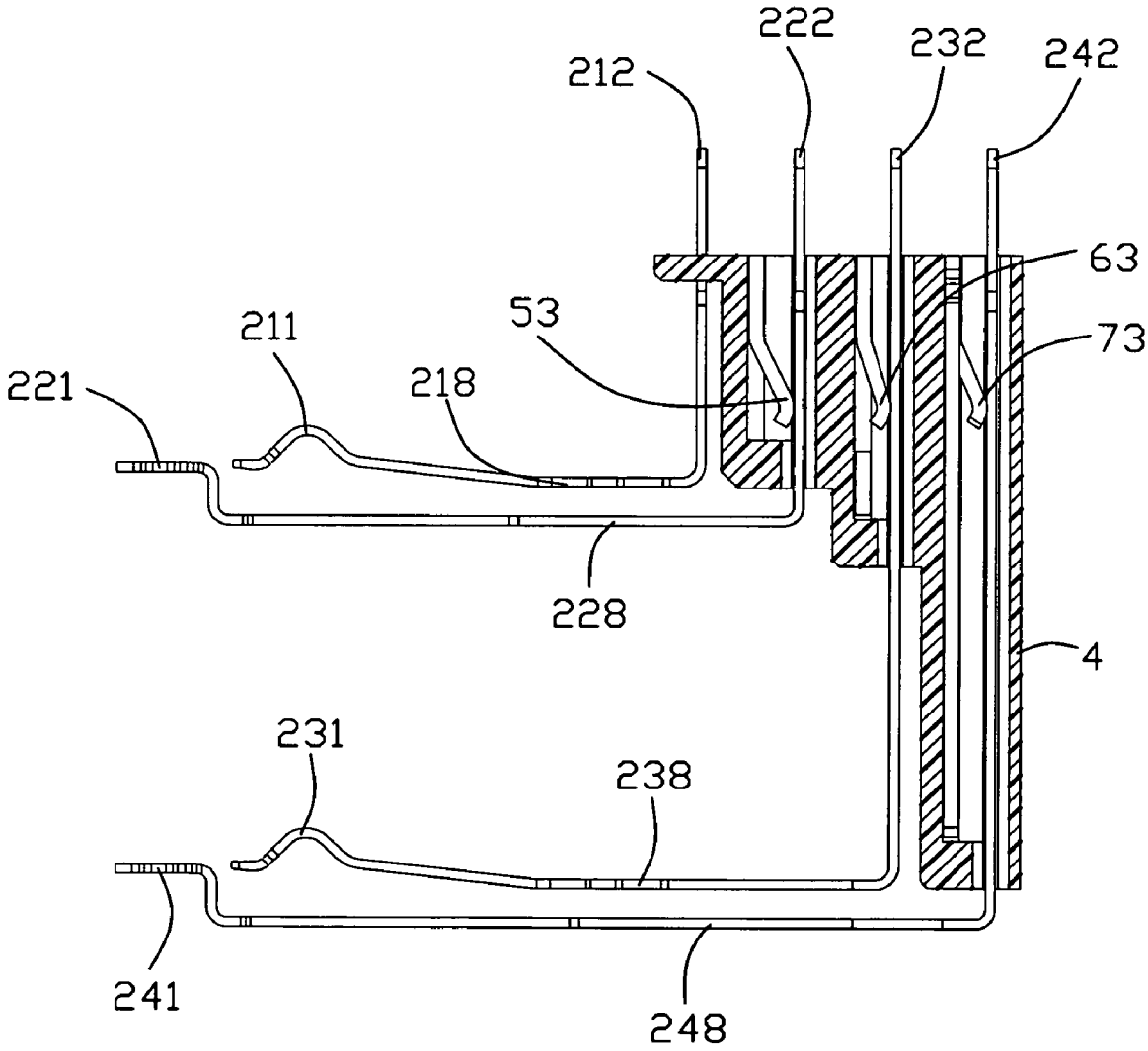
FIG. 7 is a cross-sectional view of the electrical connector taken along line 7-7 of FIG. 6.

Referring to FIGS. 5 to 7, the contacts 2 include top and bottom group of contacts respectively located in upper and lower receptacles. The lower group of contacts include four first contacts 21 and five second contacts 22. Each first contact 21 comprises a convex elastic first contact portion 211, a first tail portion 212 essentially perpendicular to the first contact portion 211, and a first mounting portion 218 connecting the first contact and tail portions 211, 212. The four first contacts 21 are for USB 2.0 type-A receptacle protocol to transmit USB 2.0 signals. In detail, the four first contacts 21 are power (VBUS) contact 213, – data contact 214, + data contact 215 and grounding contact 216, respectively. Each second contact 22 comprises a flat second contact portion 221, a second tail portion 222 perpendicular to the second contact portion 221, and a second mounting portion 228 connecting the second contact and tail portions 221, 222. The five second contacts 22 include a second grounding contact 223 and two pairs of differential contacts 224, 225, 226, 227 located on two lateral sides of the second grounding contact 223 as best shown FIG. 4. Such differential contact pairs 224, 225 and 226, 227 are used for transmitting high-speed signals.

The configuration of the upper group of contacts are similar to the lower group of contacts. The upper group of contacts include a plurality of third contacts 23 and fourth contacts 24. Each third contact 23 comprises a convex elastic third contact portion 231, a third tail portion 232 essentially perpendicular to the third contact portion 231, and a third mounting portion 238 connecting the third contact and tail portions 231, 232. The third contacts 23 are for USB 2.0 type-A receptacle protocol to transmit USB signals as well. In detail, the four third contacts 23 are power (VBUS) contact 233, – data contact 234, + data contact 235 and grounding contact 236, respectively. Each fourth contact 24 comprises a flat fourth contact portion 241, a fourth tail portion 242 perpendicular to the fourth contact portion 241, and a fourth mounting portion 248 connecting the fourth contact and tail portions 241, 242. The five fourth contacts 24 include a grounding contact 243 and two pairs of differential contacts 244, 245, 246, 247 located on two lateral sides of the grounding contact 243 as best shown FIG. 4. Such differential contact pairs 244, 245 and 246, 247 are used for transmitting high-speed signals as well.

In the preferred embodiment of the present invention, the second contacts 22 and fourth contacts 24 are inserted in the corresponding lower and upper tongue plate portions 60, 50, respectively, by insert molding technology. Under this circumstance, the second and fourth contact portions 221, 241 are supported in the depressions 604, 504 of the lower and upper tongue plate portions 60, 50. However, in other embodiments, the tongue plate portions 50, 60 can be integrally molded with the insulator 10 wherein the tongue plate portions 50, 60 can define a plurality of contact passageways for receiving the second and fourth contacts 22, 24.

Regarding to FIGS. 1-3, the metal shield 3 is in a tube shape and preferably stamped from a single sheet of suitable conductive material. The metal shield 3 includes a top wall 31, opposed side walls 32 and a bottom wall 33. The side walls 32 and bottom wall 33 each have longitudinal springs 34 extending into corresponding receiving openings 70, 80 to abut against an inserted plug (not shown). The side walls 32 further have a plurality of board locks 35 extending downwardly to be inserted through the PCB on which the electrical connector 100 is mounted.

The electrical connector 100 further comprises a front shield 36 covering the separated protrusion 14 and a rear shield 37 retained to a rear side of the metal shield 3. The front shield 36 comprises a pair of arms 361 fixed to a front side of the metal shield 3.

During assembly, the second contacts 22 and fourth contacts 24 are insert molded with the tongue plate portions 50, 60 to become two modules as shown in FIG. 4. Then, the modules are inserted into the corresponding U-shaped slots 121, 131 from the front surface 110 of the insulator 10. The latches 502, 602 are hooked in the slots 121, 131 so that the modules can be fixed to the insulator 10. The main bodies 501, 601 protrude forwardly from the front surface 110. The second and fourth tail portions 222, 242 extend through corresponding passageways 122, 132. Then, the tail portions 222, 242 are bended perpendicular to the second and fourth contact portions 221, 241. The first and third USB 2.0 contacts 21 and 23 are inserted into the insulator 10 from the rear surface 111 thereof. The first and third contact portions 211 and 231 extend through corresponding passageways 122, 132 and further extend beyond the front surface 110 of the insulator 10. Simultaneously, the first and third contact portions 211 and 231 are located under the tongue plate portions 50, 60. The second and fourth contact portions 221, 241 are exposed to the receiving openings 70, 80 and the first and third contact portions 211 and 231 further extend beyond the tongue plate portions 50, 60 along a vertical direction to protrude into the receiving openings 70, 80. The first contact portion 211 and the second contact portion 221 are located on different horizontal planes as best shown in FIG. 5. The second contact portion 221 is much closer to the free end 603 of the lower tongue plate portion 60. For the same configuration, the third contact portion 231 and the fourth contact portion 241 are located on different horizontal planes as well. The fourth contact portion 241 is much closer to the free end 503 of the upper tongue plate portion 50.

Figure 8:
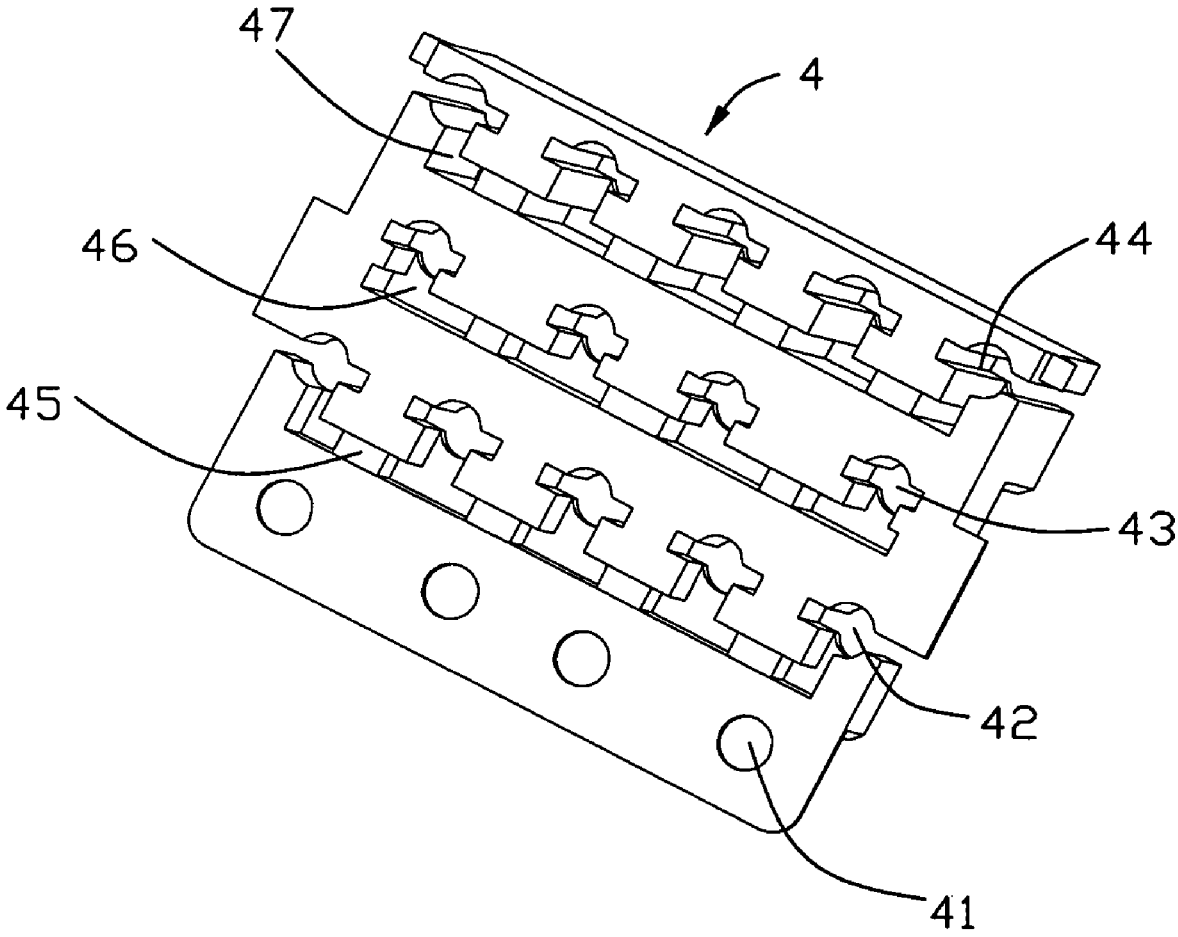
FIG. 8 is a perspective view of the spacer showing a plurality of slots for receiving the ground pieces.

In order to organize all the tail portions 212, 222, 232, 242 in preliminary position, the electrical connector 100 further comprise a spacer 4 fixed to a bottom side of the insulator 10. As shown in FIGS. 6-8, the spacer 4 defines a plurality of through holes 41, 42, 43, 44 and a plurality of slots 45, 46, 47. The through holes 41, 42, 43 and 44 are arranged in four parallel rows designated a first, a second, a third and a fourth row. The slots 45, 46 and 47 are parallel to each other and parallel to each row of the through holes 41, 42, 43, 44. The slots 45, 46 and 47 are designated a first slot, a second slot, and a third slot, respectively. As shown in FIGS. 6-8, the first slot 45 is located between the first and second rows of the through holes 41 and 42. The second slot 46 is located between the second and third rows of the through holes 42 and 43. The third slot 47 is located between the third and fourth rows of the through holes 43 and 44. It means that there exists a slot between adjacent two rows of the through holes. All the first, second, third and fourth tail portions 212, 222, 232, 242 of the contacts 2 respectively extend through the first, second, third and fourth rows of the through holes 41, 42, 43 and 44 so that the tail portions 212, 222, 232 and 242 can be easily soldered to the PCB.

In order to decrease cross-talk influence and control impedance between such contacts 2, the electrical connector further comprise a first, a second and a third metallic ground pieces 5, 6, 7 received in the first, second and third slots 45, 46, 47, respectively. Each ground piece 5, 6, 7 comprises a retaining portion 51, 61, 71 pressed into corresponding slots 45, 46, 47 along a lower-to-upper direction and a plurality of separate extensions 52, 62, 72 fixed to the slots 45, 46, 47. Each ground piece 5, 6, 7 further comprises an elastic contact beam 53, 63, 73 electrically connected to corresponding mounting portions 218, 228, 238, 248 of the grounding contact 243, 236, 223, respectively. As a result, the surface of the grounding contact 243, 236, 223 is expanded, because the ground piece 5, 6, 7 is recognized as a part of the grounding contact 243, 236, 223, to decrease cross-talk occurred between the contacts 2. Besides, addition of the ground piece also help lower the impedance in that area. The ground pieces 5, 6 and 7 don't need to be soldered to the PCB for easily assembly. Besides, since the ground pieces 5, 6 and 7 are received in the spacer, it does not affect the footprint of the electrical connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector, comprising:

an insulative housing;

a plurality of first and second contacts retained in the insulative housing, each first contact comprising a first contact portion and a first mounting portion, each second contact comprising a second contact portion and a second mounting portion, the first and second mounting portions being respectively arranged in first and second rows, the second contacts comprising a grounding contact; and a metallic ground piece located in a third row between the first row and the second row, the ground piece being electrically connected to the grounding contact; and a spacer mounted to the insulative housing with the ground piece retained therein in condition that tail portions of the second contacts are regulated in the spacer.

2. The electrical connector as claimed in claim 1, wherein the second contacts comprise two pairs of differential contacts located on two lateral sides of the grounding contact, respectively.

3. The electrical connector as claimed in claim 1, wherein the insulative housing comprises a tongue plate portion, the second contact portion being located closer to a free end of the tongue plate portion than that of the first contact portion.

4. The electrical connector as claimed in claim 3, further comprising a metal shield enclosing the tongue plate portion to define a receiving opening therebetween, the first contact portion extending beyond the tongue plate portion and further extending into the receiving opening, the second contact portion being supported by the tongue plate portion and exposed to the receiving opening.

5. The electrical connector as claimed in claim 1, wherein the spacer defines a slot between the first and second rows, the ground piece being pressed into the slot along a lower-to-upper direction.

6. The electrical connector as claimed in claim 1, wherein the electrical connector is provided for being mounted on a PCB while the ground piece is not soldered to the PCB.

7. The electrical connector as claimed in claim 1, wherein tail portions of the first contacts are regulated in the spacer as well.

8. The electrical connector as claimed in claim 1, wherein the first contacts comprise a power contact, a pair of differential signal contacts and an another grounding contact in ordinal arrangement, and wherein the electrical connector comprises another ground piece having an another elastic contact beam abutting against said another grounding contact.

9. A stacked electrical connector, comprising:

a top tongue plate portion and a bottom tongue plate portion;

a plurality of top and bottom group of contacts mounted on the top and bottom plate portions, respectively, the top group of contacts comprising first and second mounting portions, the bottom group of contacts comprising third and fourth mounting portions, the top and bottom group of contacts comprising first and second grounding contacts, respectively; and a pair of first and second metallic ground pieces, the first metallic ground piece being located between the first and second mounting portions, and the second metallic ground piece being located between the third and fourth mounting portions, and wherein the first and second ground pieces are electrically connected to the first and second grounding contacts, respectively; and wherein the stacked electrical connector comprises a spacer to fix the first and second ground pieces and the tail portions of the top group of contacts are regulated in the spacer.

10. The stacked electrical connector as claimed in claim 9, wherein the bottom group of contacts comprise a first contact portion connecting the first mounting portion, and a second contact portion connecting the second mounting portion, and wherein the first and second contact portions are located on different planes.

11. The stacked electrical connector as claimed in claim 9, wherein the tail portions of the top and bottom group of contacts comprise a first, a second, a third and a fourth tail portion respectively extending from the first, second, third and fourth mounting portion, the electrical connector further comprising a spacer defining a plurality of through holes to receive the first, second, third and fourth tail portions.

12. The stacked electrical connector as claimed in claim 11, wherein the spacer defines first and second slots, the first and second ground pieces being pressed into the first and second slots along a lower-to-upper direction.

13. The stacked electrical connector as claimed in claim 9, further comprising a third ground piece located between the first and second mounting portions of the top group of contacts, and the third and fourth mounting portions of the bottom group of contacts.

14. The stacked electrical connector as claimed in claim 9, wherein the tail portions of the bottom group of contacts are regulated in the spacer as well.

15. An electrical connector comprising:

an insulative housing defining at least one mating port with a mating tongue extending therein;

a set of first contacts having resilient contacting portions exposed upon a mating face of said mating tongue;

a set of second contacts having relatively stiff contacting portions exposed upon the same mating face while offset from said resilient contacting portion in a front-to-back direction;

a grounding plate extending in a transverse direction of said mating port;

a middle one of said set of second contacts mechanically and electrically connected to the grounding plate; further including a spacer in which tails of the set of the first contact and the set of the second contacts are regulated and said grounding date is held.

16. The electrical connector as claimed in claim 15, wherein said grounding plate includes a vertical portion held in said spacer.

17. The electrical connector as claimed in claim 16, wherein each set of said set of first contacts and said set of second contacts are ranged side by side in the transverse direction, and said spacer separates the set of first contacts and the set of second contacts from each other in said front-to-back direction.

18. The electrical connector as claimed in claim 16, wherein at least one of said set of first contacts or said set of second contacts is electrically and mechanically engaged with the vertical portion of the grounding plate.

19. The electrical connector as claimed in claim 15, wherein each set of said set of first contacts and said set of second contacts are arranged side by side in the transverse direction, and said spacer is located between and separates the set of first contacts and the set of second contacts from each other.

20. The electrical connector as claimed in claim 15, wherein at least one of said set of first contacts or said set of second contacts is electrically and mechanically engaged with the grounding plate.

* * * * *